United States Patent [19]

Sekhar

[11] Patent Number: 4,611,688

[45] Date of Patent: Sep. 16, 1986

[54] RE-WINDABLE FIRE ESCAPE

[76] Inventor: Rajagopalan C. Sekhar, 3 Twilight Dr., Foxboro, Mass. 02035

[21] Appl. No.: 757,365

[22] Filed: Jul. 22, 1985

[51] Int. Cl.[4] ..... A62B 1/10

[52] U.S. Cl. ..... 182/237; 182/232; 182/234; 182/239; 254/332

[58] Field of Search ..... 182/231–234, 182/71–73, 142, 5–7, 237, 239; 254/332

[56] References Cited

U.S. PATENT DOCUMENTS 936,385 10/1909 Thornburg ..... 182/238

*Primary Examiner*—Reinaldo P. Machado
*Assistant Examiner*—Alvin Chin-Shue
*Attorney, Agent, or Firm*—M. K. Silverman

[57] ABSTRACT

There is disclosed herein a fire escape for the lowering of a plurality of escapees to the ground. Included in the present structure is a shaft, a spool journalled upon the shaft, a cable having a first and second end, the first end secured to the journal of the spool, in which the cable has a length generally equal to the distance of the spool above the ground. Also provided are body securement means affixed to the second end of the cable for use by the escapee. Further provided is a flywheel which is rotationally coupled to the spool; the flywheel constitutes a means for acquiring and storing angular momentum developed therein during descent of the cable to the ground. Also included in the present inventive fire escape are means for rotationally transferring the angular momentum from the flywheel back to the spool to thereby effectuate the rewinding of the cable so that the body securement means can thereby be used by the next escapee. Further provided are descent and ascent angular velocity limit means.

6 Claims, 10 Drawing Figures

FIG. 1A
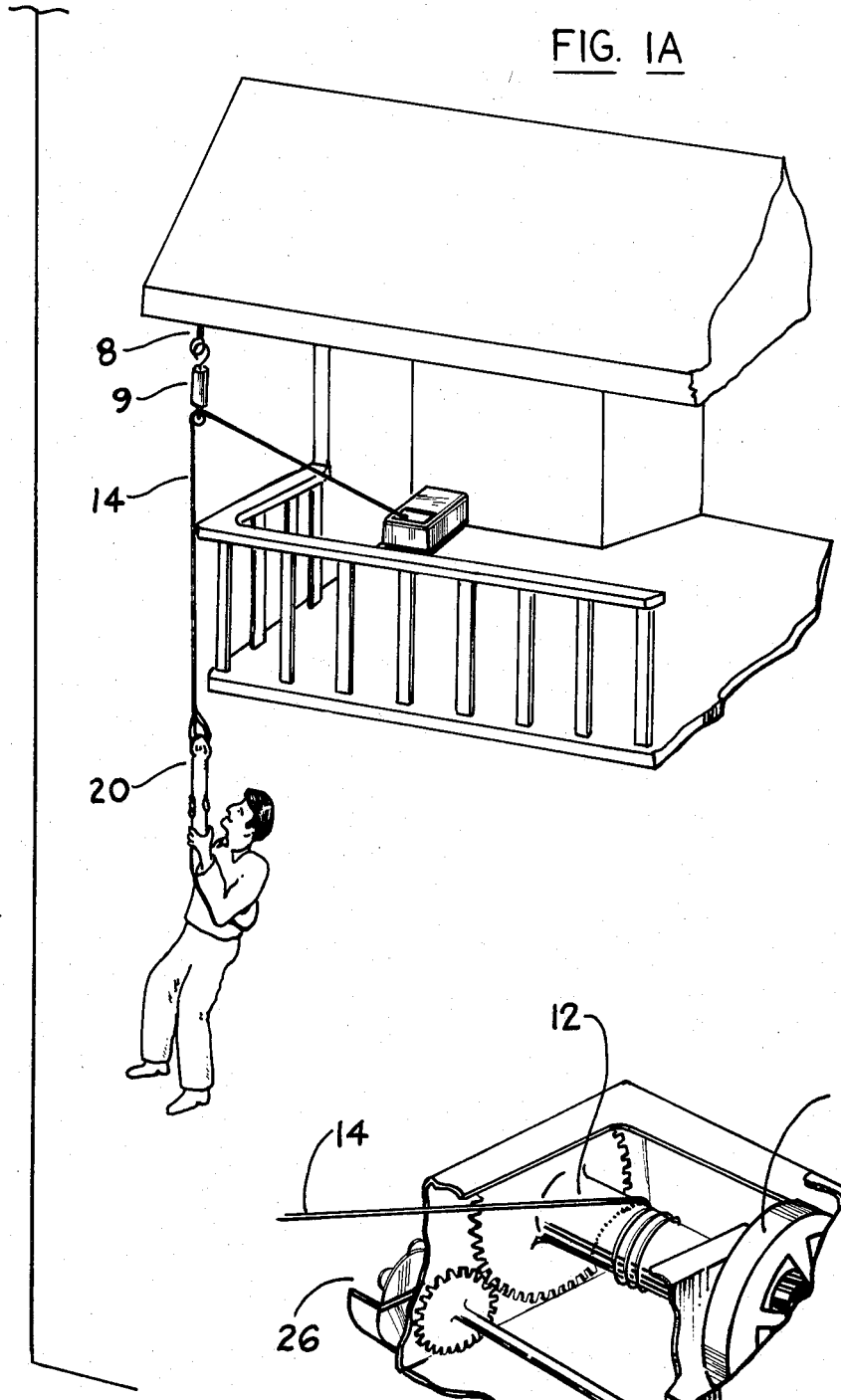
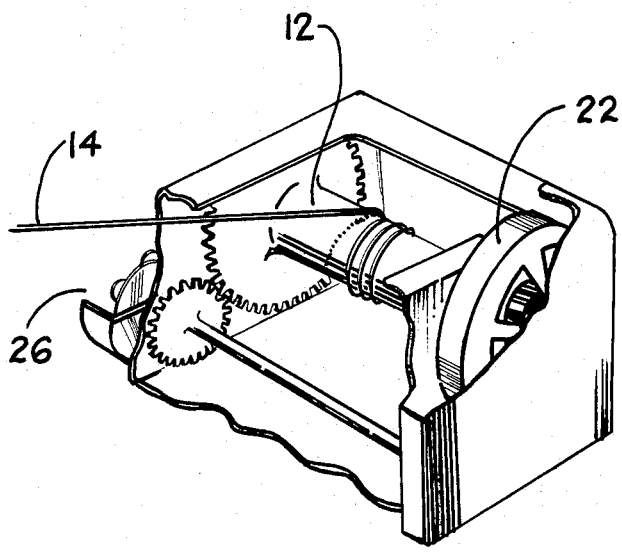
FIG. 1B

RE-WINDABLE FIRE ESCAPE

BACKGROUND OF THE INVENTION

The present invention relates to fire escape devices which are suitable for use by a plurality of escapees.

The present invention is concerned with two problems that have developed in the field of fire escapes as a result of the advent of highrise structures. The first of these is the provision of a fire escape by which a potential escapee can depart, from a window or balcony of the highrise structure, directly to the ground. Prior art efforts along this line have been limited to less than a dozen floors as the maximum height from which a potential escapee can safely depart.

A second area of concern to which the present invention is addressed is the reuseability of such a highrise fire escape device in order to permit the re-cycling of the apparatus to permit a plurality of potential escapees to depart from a highrise window or balcony.

The prior art known to the Applicant, having some relationship in structure to the Applicant's invention, comprises U.S. Pat. Nos. 375,393 to Stockham, 818,526 to Davy; 835,985 to Sharp; 1,131,127 to Feigenbaum; 2,721,685 to Frankel and 4,437,546 to Marinoff.

The most relevant areas of classification, in the opinion of the Applicant, are U.S. Class No. 182, Subclasses 236 and 239.

SUMMARY OF THE INVENTION

The present invention is a fire escape intended for use in the lowering of a plurality of escapees to ground level. The fire escape includes a shaft; a spool journalled on said shaft; cable means having a first end and a second end, said first end secured to the journal of said spool, said cable means having a length generally equal to the distance of said spool above the ground; body securement means, such as a harness, affixed to the second end of said cable means for use by an escapee; a flywheel rotationally coupled to said spool, the flywheel comprising means for acquiring and storing angular momentum developed therein during the descent of the escapee and the descent of said cable means to the ground; and means for rotationally transferring said angular momentum from said flywheel back to said spool to thereby effectuate the re-winding of the cable means, so that said body securement means can thusly be used by the next escapee.

It is an object of the present invention to provide an apparatus which will lower one or more persons from a burning or threatened residential or commercial structure at a controlled rate of safe descent and automatically return the apparatus much quicker to its original position to be used again by a second potential escapee.

It is a further object to provide a device that will automatically unwind a supporting cable and will enable a lowered person to move downward at a safe speed of descent.

A further object is to provide an escape apparatus including means for disengaging the unwind/re-wind function of the apparatus during the disengagement of the escapee from the body securement harness at ground level.

The above and yet further objects and advantages of the present invention will become apparent from the hereinafter set forth detailed description of the invention, the drawings, and the appended claims.

BRIEF DESCRIPTION OF THE DRAWINGS

FIG. 1A is an illustration of the general environment within which the invention is to be used, including a detail FIG. 1B of the inventive structure.

DETAILED DESCRIPTION OF THE INVENTION

Shown in FIG. 1 is a general environment view of one manner in which the present invention might be installed upon the balcony of a highrise building. It is, however, to be understood that the present invention may be utilized in buildings not equiped with balconies. However, in each instance, a fixed location for the present inventive fire escape is necessary. Therefore, where a balcony is not available, the present inventive fire escape will be stored on the inside wall or floor of the building, underneath the "escape window".

Figures 2, 3:
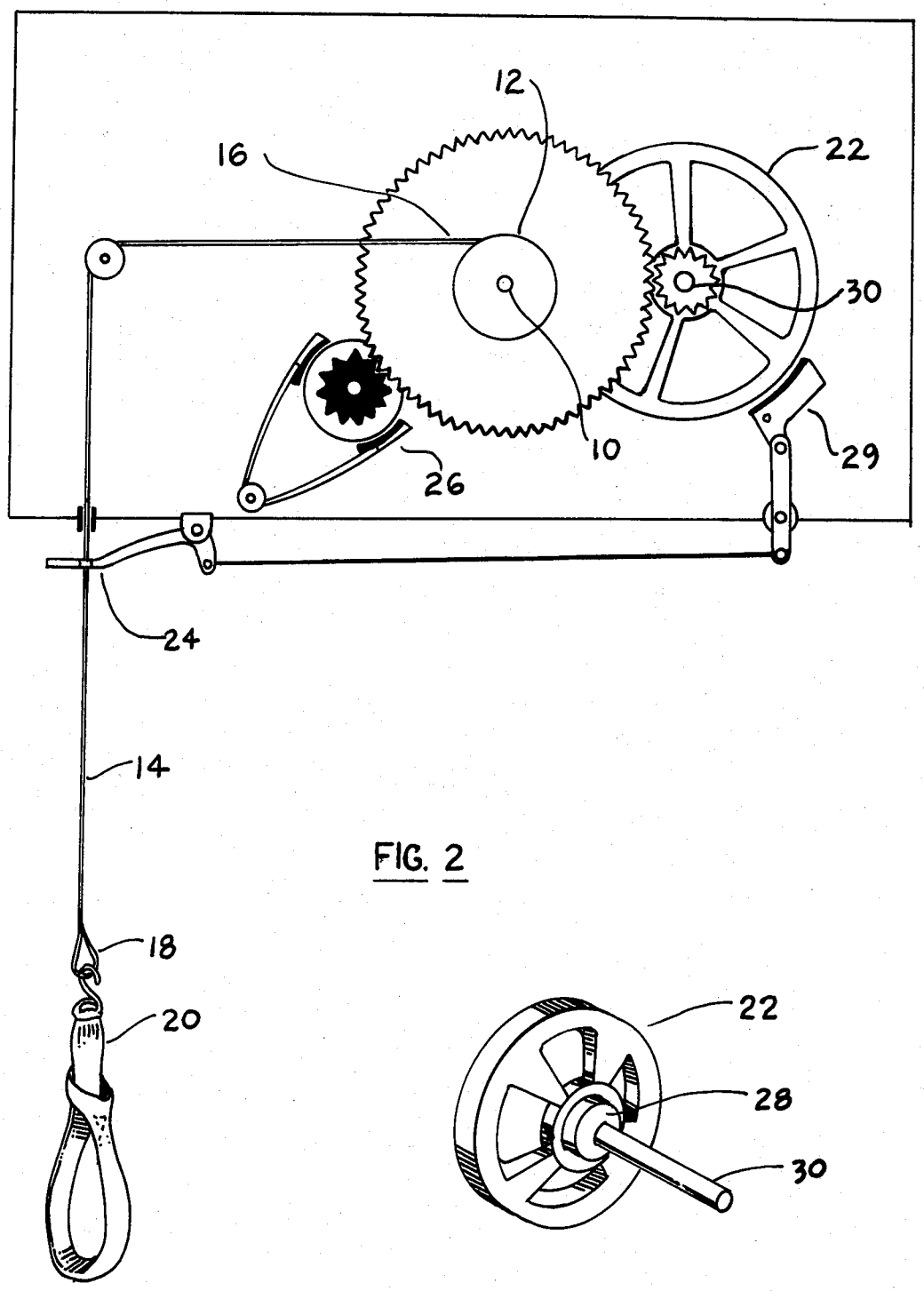
FIG. 2 is a schematic showing the general principles of the operation of the present invention.
FIG. 3 is a detail of the slip clutch of the illustration of FIG. 2, thereby showing a first embodiment of the invention.

With reference to FIG. 2, a first embodiment showing the broad principles of the present invention is shown. More particularly, in the embodiment of FIG. 2 is shown an axial shaft 10 having a spool 12 journalled upon said shaft 10. Also provided are cable means 14 having a first end 16 and a second end 18, in which said first end 16 is secured to the spool 12, and said second end 18 is secured to a body securement means or harness 20, which is used by the escapee.

It is to be noted that, in the instant embodiment, the length of the cable means 14 must, during the installation of the fire escape system, be made approximately equal to the distance of the spool 12 above the ground. This is necessary in order to insure that the escapee will be lowered only as far as the ground level and the cable does not become unduly slack at the spool end when it is completely played-out. However, in a third embodiment of the invention, described below, premeasurement of the cable length is not necessary.

With further reference to FIG. 2, there is shown a flywheel 22 mounted upon an axis 30 and, thereby, rotationally coupled to said spool 12. This arrangement of the flywheel comprises a means for acquiring and storing much of the angular momentum developed during the descent of said cable means 14 to the ground level. Further, during the ascent stage, said rotational coupling can also transfer angular momentum from the flywheel 22 back to the spool 12 to eventually effectuate the re-winding of the cable means to the top start position, so that the harness or body securement means 20 can thereby be used by the next potential escapee.

In each of the embodiments of the invention, the flywheel acts as the means by which angular momentum developed during the descent is stored and eventually transferred back to the spool in order to accomplish the re-winding thereof and, thusly, the re-cycling of the present system so that further escapees can safely depart from their threatened position on the highrise structure.

As may be appreciated in FIG. 2, the interaction of the flywheel with the spool will cause the spool to continue to keep turning in the counter-clockwise direction in order to enable the spool to keep rotating in such counter-clockwise direction and, thereby, to simply rewind the cable means.

It is to be also appreciated that the "separate axis" arrangement of the spool and flywheel of FIG. 2 represents but one so-called positive rotational engagement embodiment and that other means of transferring the angular momentum from the flywheel back to the spool in separate axial arrangements will be obvious to those ordinarily skilled in the art.

As a necessary safety feature, the embodiment of FIG. 2 is provided with a brake means 26 which comprises means for limiting the speed of descent of the cable means. The need for such a speed limit means is apparent in that, where the escapee is descending from a height, the speed of descent must be limited in order to enable the escapee to reach the ground level at a safe velocity and in the absence, at that point, of any acceleration. In FIG. 2, a simple pressure brake is shown. However, as may be appreciated, more sophisticated braking arrangements involving centrifugally operated brake shoes (hereinafter described in later embodiments) may be employed.

With reference to FIG. 3, there is shown one means by which the safe disengagement of the escapee from the body harness 20 can be accomplished. More particularly, in FIG. 3, the axis 30 of the flywheel 22 is provided with a slip clutch 28 disposed within said axis 30 of rotation. Slip clutch 30 is provided with a slip torque sufficiently low as to permit slippage between the flywheel 22 and its axis 30 responsive to the mass of the escapee when the escapee is still on the cable and is in the process of disengagement from the harness at ground level. Through the use of the flywheel slip clutch 28, the ascent of the cable cannot begin until the escapee has disengaged from the body harness and released the same, thereby stopping any further slippage of the slip clutch and permitting the flywheel to then operate in a normal fashion, that is, permitting the flywheel to transfer its angular momentum to the spool, thereby giving the spool the force necessary to re-wind the weight of the cable.

In the embodiment of FIGS. 2 and 3, it is to be noted that the slip clutch 28 also slips under the tension of an entirely rewound cable, thereby stopping any further rewinding of the cable means 14 and hence undue tension in it, after re-winding has occurred. In addition, flywheel arrester brake means 29 is actuated at this stage and arrests any remaining angular momentum in the flywheel so that the flywheel is completely at a standstill and is ready to turn in the opposite direction for the next escapee.

Figures 4, 5:
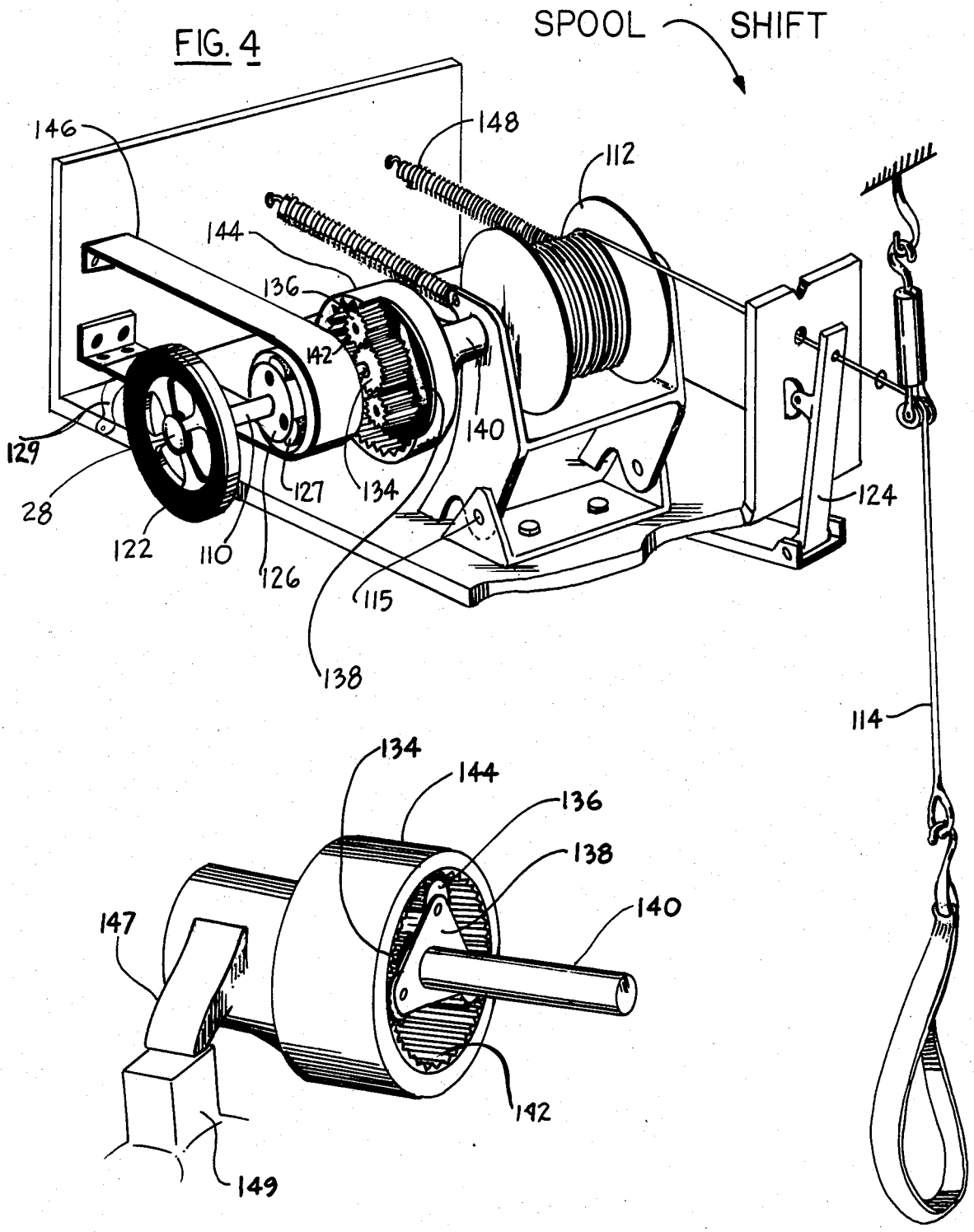
FIG. 4 is a schematic view of the second embodiment of the invention illustrating the use of planetary gearing to accomplish slip clutch and brake functions.
FIG. 5 is a perspective view of the ring gear housing of a second embodiment of the invention.

With reference to FIG. 4 there is shown a second embodiment to the present invention in which the angular momentum transfer means is comprised of a power train including a flywheel 122 mounted upon an axis 110 upon which a spool 112 is also mounted. Further provided is a sun gear 134, which is rotationally mounted upon said axis 110, and disposed medially between said spool 112 and said flywheel 122. In this arrangement, said sun gear 134 is powered by said flywheel 122.

In the embodiment of FIG. 4 there is also provided a group of planetary gears 136, which are mounted in rotational mesh and in the same radial plane with said sun gear 134. In this arrangement, which is more fully illustrated in FIG. 5, is also provided cage means 138 which serve to hold said planetary gears 136 in a fixed radial disposition to said sun gear 134. FIG. 4 are also shown integral securement means 140 by which said cage means 138 is maintained in rotational lock with spool 112. Therefore, any rotation of spool 112 must be identically transferred to cage means 138 and vice versa.

Also provided in the arrangement of FIG. 4 are descent velocity limit (braking) means which comprise a ring gear 142 and a surrounding ring gear housing (rgh) 144. Therein, said ring gear 142 is in peripheral rotational mesh with the said planetary gears 136. Therefor, in order for all gears within the said rgh 144 to rotate, the rgh 144 must be held static (non-rotational). When this is done, the power train running from the flywheel to the sun gear to the planetary gears to the cage and ultimately, to the spool, can operate. A further element of the descent limit means is band means 146 (or any suitable alternative, such as a positive locking arrangement, shown in FIG. 5) which peripherally engage said rgh 144 responsive to a pre-established translational location of the said rgh 144. More particularly, there is provided a spring means 148 which is translationally coupled to said shaft 110 in which said spring means 148 operates to control the mass upon the rgh 144 at which a forward translational position (see arrow in FIG. 4) of said rgh 144 will be caused by the mass of the escapee on the cable means. When the band means 146 engages the rgh 144, the power train is engaged, thereby enabling the flywheel to operate through said power train in order to perform its function of acquiring and storing angular momentum.

In the arrangement of FIG. 4, there is also provided brake means 126 which are rotationally integral to said sun gear 134 in which said brake means 126 includes brake shoes 127 which actuate in response to defined levels of centrifugal force. In this arrangement, said brake shoes 127 will, at a defined angular velocity thereof, expand outward against the rgh 144 in order to apply torque against sun gear 134 which, thereby will limit the speed of descent of spool 112 and, thereby, of the cable 114.

It is to be noted that flywheel means 122 in this embodiment requires a slip clutch means 128 as explained in the previous embodiment and also requires a flywheel arrester brake means as explained in the previous embodiment.

A further aspect of the structure of FIG. 4 is that said band means 146 (or catch means 147 shown in FIG. 5), in interaction with said spring means 148, will be disengaged as the escapee detaches from the body securement means, thereby loosening the grip of the band means 146, or the catch means 147, upon the rgh 144, permitting the rgh to rotate freely. At this point the centrifugal brake grabs the ring gear housing tending to rotate it at the higher speed of the sun gear. This being the case, the cage, and thereby the spool means is also forced to rotate at the same higher speed causing the cable means to wind-up on the spool in the opposite direction and eventually to rewind the cable. However, as long as the escapee is still trying to disengage himself, the spool means cannot turn and the remanant frictional torque arising from the brake rubbing against the ring gear housing causes a mild tug on the cable, and the moment the escapee has disengaged himself, the cable begins rewinding at the higher speed of the sun gear.

Thereby, after the escapee has disembarked from the body cable, he will cause such backward translational positioning of the rgh in order to permit the power train to re-engage, thereby allowing the flywheel 122 to transmit angular momentum through the power train to the spool 112, and the rewind function is thereby accomplished.

The third embodiment is somewhat similar to the second embodiment, except direction reversal of the spool is accomplished by changing the planetary gearing. In the second embodiment, the spool was in integral lock with the cage of the planetary gearing. In this embodiment, however, that has been changed, and the spool is in integral lock with the ring gear housing. In the second embodiment, the ring gear housing was held static, while in this embodiment, the cage is held static. The sun gear in both of these embodiments is the same, as is the fly wheel, and the centrifugal brake. This arrangement, namely, exchanging the functions of the ring gear housing and the cage, accomplishes direction reversal of the spool.

Figure 6:
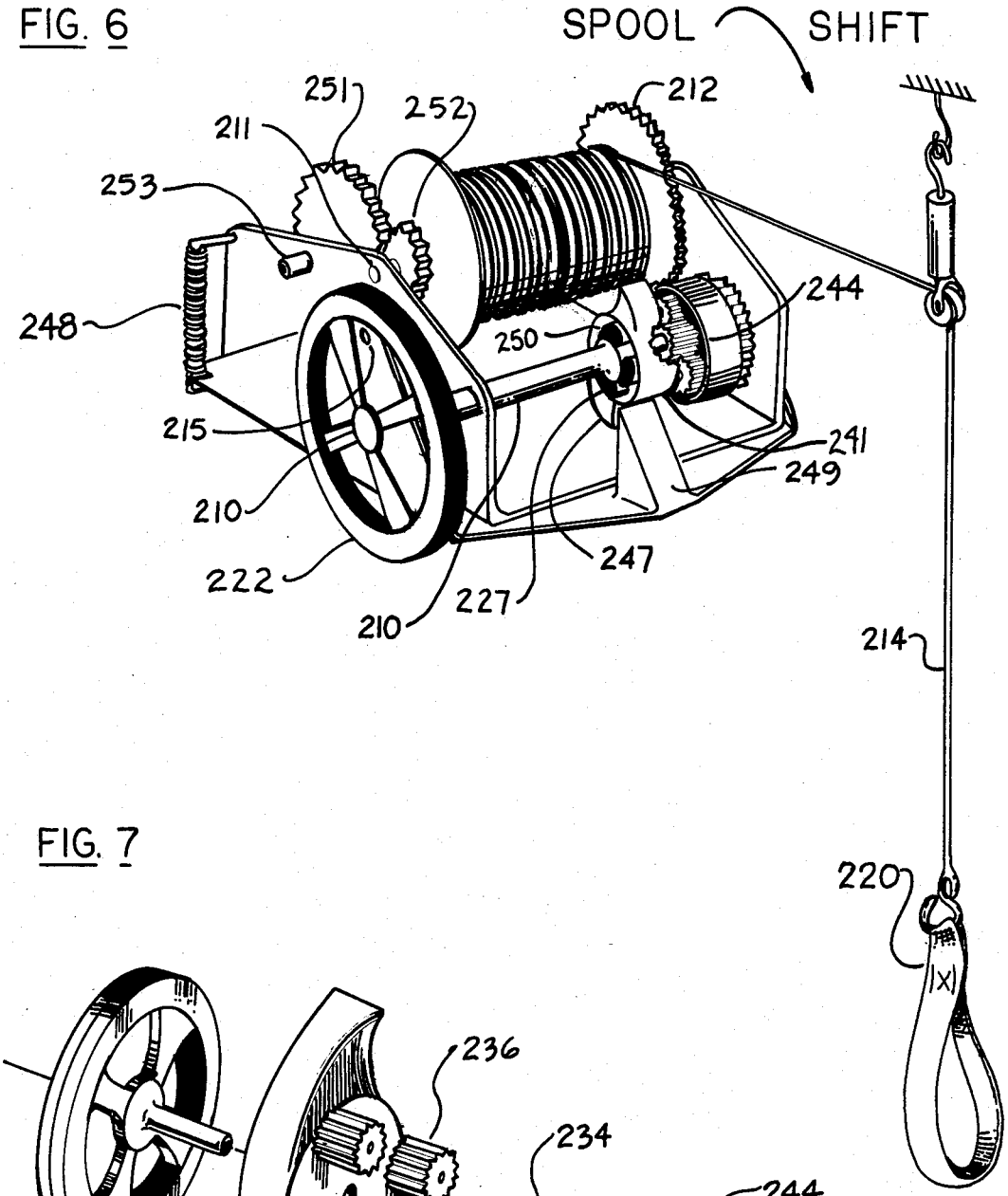
FIG. 6 is a perspective view of a third embodiment employing spool direction reversal.
Figure 7:
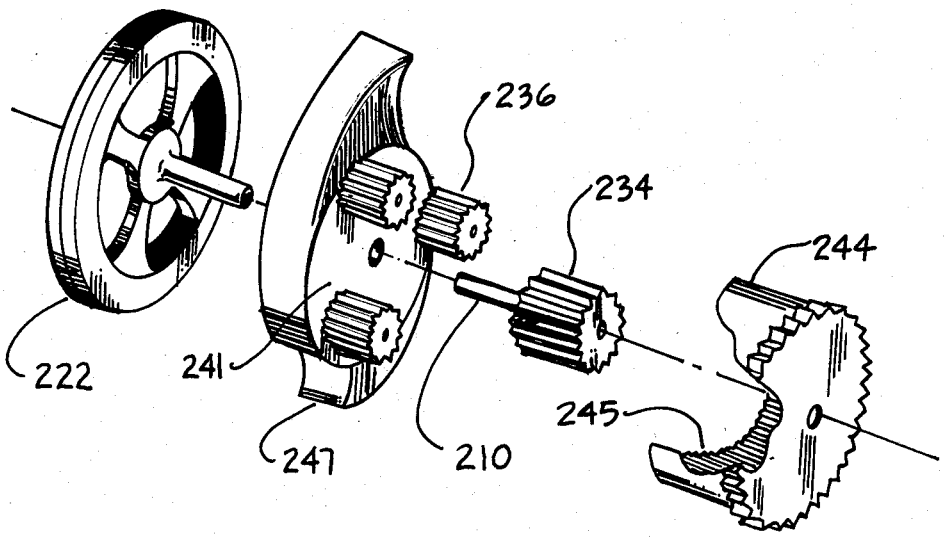
FIG. 7 is an exploded view of planetary gearing used in the third embodiment of the invention.

When the escapee gets on the harness and starts his descent, the spool 212 gets powered, due to his weight going down, and in this embodiment it is shown that the spool 212 is in rotational mesh through gearing to the entire flywheel mechanism on the primary axis 210, and so the spool 212 powers the ring gear housing 244, which is enmeshed with the spool 212, the ring gear housing (see FIG. 6) starts rotating in a counter-clockwise direction. At this point, the cage 241 tends to turn in a counter-clockwise direction, but because the spring means 248 has been pivotally extended about point 215 due to the weight of the escapee going down, catch 247 of cage 241 comes into rotational abutment with abutment means 249, and the cage does not rotate any further in the counter-clockwise direction. Since the cage is arrested from rotating, the power from the ring gear housing 244 rotation is transferred through the planet 236, rotating by themselves to the sun gear 234 which starts to rotate in the clockwise direction. Because the sun gear 234 is in integral lock with the brake means 227 and also the flywheel 222, both the brake means 227 and the flywheel 222 start to rotate in a clockwise direction. And because the brake 227 is rotating, centrifugal action causes the brake to rub against brake drum 250 which is held static by the co-action of the catch 247 and abutment 249. Hence, the brake 227 is able to effectively slow down the speed of the escapee. This process continues until the escapee touches the ground. The moment the escapee touches the ground, the spring means 248 is able to pull back the spool because the full weight of the escapee is not on the cable anymore, but is supported by the ground. However, when the spool 212 pivotally translates to the back position because of the spring means 248 pulling it back, the abutment position of the cage 241 on the shaft 210 is released, and so, the cage 241 is free to rotate, which it starts to do in the clockwise direction because the brake 227 which is in contact with the cage means 241 engages in a clockwise direction on the cage means and tends to carry it with itself. At this point, if the escapee were already free from the harness, the clockwise rotation of the flywheel 222 turning the brake means and hence, the brake means turning the cage, would start to cause the ring gear housing 248 to start rotating in a clockwise direction, because the sun gear 234 and the cage 241 are both in lock with frictional forces between the cage and the brake means. And, hence, the ring gear housing has to follow in the clockwise direction, which means the spool starts to turn in a counterclockwise direction and therefore starts to rewind the harness back automatically. That's the end of the operation.

However, there is a point to be made when the escapee has touched the ground, and yet has not disengaged himself from the harness 220, and is taking some time. At this point, we do not want the spool 212 to start rewinding the whole weight of the escapee also. As a matter of fact, it cannot, because it doesn't have the power to do it. And basically, what happens at that stage is that although the cage 241 is not in rotational lock with the abutment 249 anymore, still the spool cannot turn because of the weight of the escapee on the ground. Because the spool 212 cannot turn, the ring gear housing 244 cannot turn and, basically, is held static. Hence, the rotation of the flywheel 222 is transferred from the flywheel (which is in lock with the sun gear), to the planets 236. Since the ring gear housing 244 is stationary, the planets 236 have to turn the cage 241, which means the brake drum 250 has to start turning; therefore, the cage 241 which is integral with the brake drum 250 starts turning; however, it cannot turn at the same speed as the brake 227 which is secured to the shaft 210, and so there is a slip between the shaft 210 and the cage means 241. And this slip basically is what prevents the person from being pulled-up. This slip action functions as a slip clutch would. Therefore, it is to be noted that in this embodiment, there is no necessity for a slip clutch, except for a certain refinement which would lessen the time of descent in the initial stage of the journey which would make it more psychologically appealing to the escapee. When the escapee disengages himself from the harness, the operation described previously, comes into play and the brake means 227 locks the brake drum 250 and rotates the cage means 241 with itself and also carries the entire ring gear housing also with itself. The whole unit starts to turn the spool and the cable starts to move up. It is noted that in this embodiment, the planets 236 are mounted on the cage means 241 and they are free to rotate on their own axes, but they are integral with the cage means 241, which is also the brake housing, whereas the sun gear 234 is mounted upon the central axis 210 of the entire assembly.

It is through the pivot action on pivot 215, that the translational movement of the spool is accomplished in order to take the brake housing 241 out of engagement with the abutment 249 in order to permit rotation when the spool is in its translationally retracted position.

In addition, gear 252 which is rotationally fixed to shaft 211 and hence to the spool 212, and gear 251 which is rotationally fixed to shaft 253, are provided as a manual standby to wind the cable up by using a separate manual handle which can be rotationally appended to shaft 253 by a keying action. The handle rotation transfers to the spool 212 through the above mentioned gears to obtain a manual rewind action.

Figure 8:
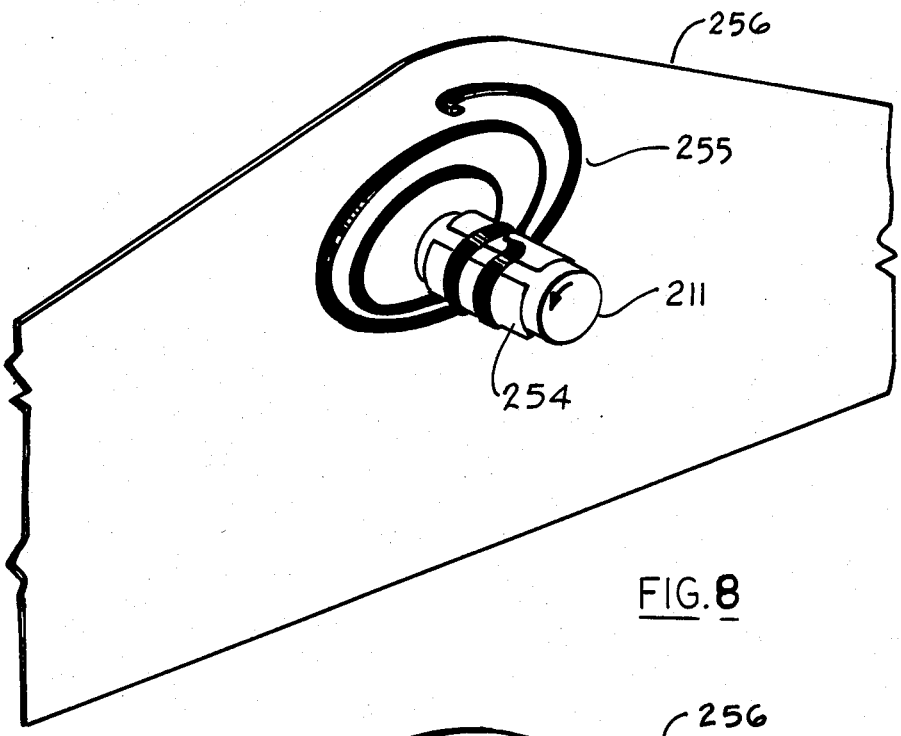
FIGS. 8 and 9 are perspective views of a cable tensioning means for use during initial escape procedures.
Figure 9:
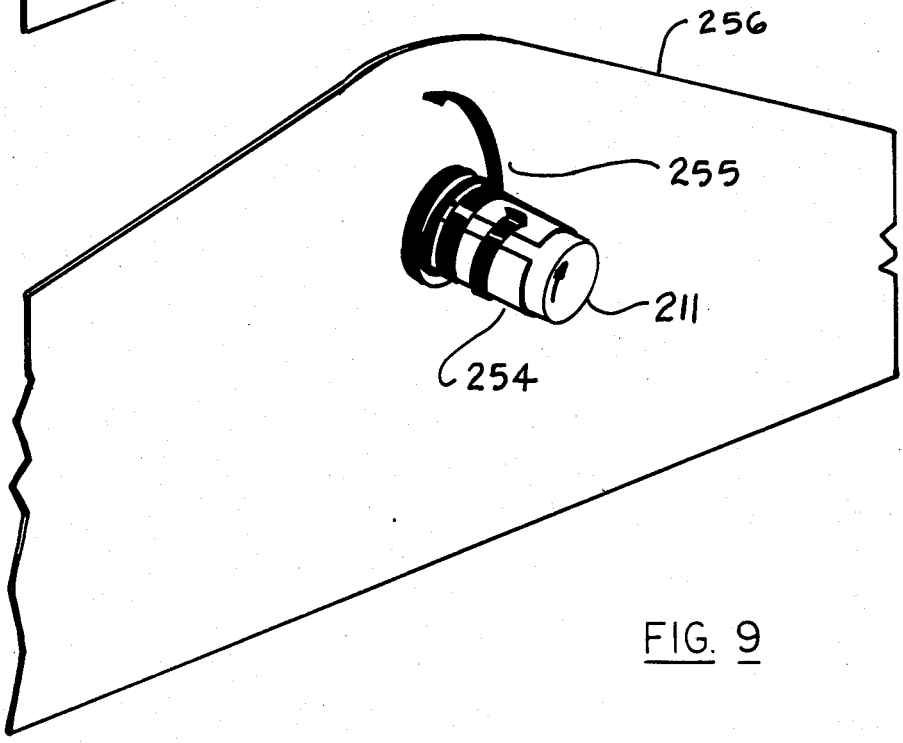

As a further refinement of the cable action, a spring means and a split spring-sleeve means is used to keep the cable taut during initial maneuvering motions of hooking the cable into its starting position (See FIGS. 8 and 9).

Shaft means 211 which projects outside of its journal is fitted with a snug-fitting split spring-sleeve means 254 which holds tightly onto the shaft means 211 until a specified breakaway torque is developed between said sleeve means 254 and said shaft means 211.

Torsion spring means 255 is fixed on one end to the journal housing 256 and is wrapped around the split spring-sleeve means 254 at its other end, in the manner of a wrap-spring, one-way clutch known to those familiar with the clutch art.

On pulling the cable means during initial hook-up procedures, the spool unwinds quite freely except that the wrap-spring end of the torsion spring means 255 engages with the split spring-sleeve means 254 and so starts to wind up. Once the torsion spring means 255 is fully wound-up on itself (See FIG. 9), the breakaway torque of the split spring-sleeve means 254 is exceeded and the spool shaft means 211 slips from the grip of the split spring-sleeve means and hence allows further cable to be played-out only under a constant tension primarily due to the wound-up disposition of the torsion spring means 255. This tension eliminates any unwieldy slack generated in the cable during a possible inadvertent extra play-out, especially at the time of hook-up.

During ascent of the cable, the wrap-spring end of the torsion spring means 255 slips freely over the split spring-sleeve means 254 causing no dissipation of flywheel energy in the wind-up direction of the spool's rotation.

Accordingly, while the preferred embodiments of the invention have been shown and described, it will be understood the invention may be embodied otherwise and that within such embodiments certain changes in the detail, construction and/or a form arrangement of parts may be made without departing from the underlying ideas or principles of this invention within the scope of the appended claims.

Having thus described my invention what I claim as new, useful and non-obvious and, accordingly, secure by Letters Patent of the United States is:

1. A fire escape for lowering a plurality of escapees to the ground, comprising:

(a) a shaft;

(b) a spool journalled upon said shaft;

(c) cable means having a first and second end, said first end secured to the journal of said spool, said cable means having a length generally equal to the distance of said spool above the ground;

(d) body securement means affixed to the second end of said cable means for use by an escapee;

(e) a flywheel rotationally coupled to said spool, said flywheel comprising means for acquiring and storing angular momentum developed therein during the descent of the escapee and of said cable means to the ground; and (f) means for rotationally transferring said angular momentum from said flywheel back to said spool to thereby effect the rewinding of said cable means so that said body securement means can thusly be used by the next escapee, said rotational transfer means comprising a power train which automatically effects reversal of the spool rotation when the escapee detaches from said cable means at ground level, thereby causing a rewind of the said cable means, in which said power train comprises:

(i) a primary axis and a secondary axis in which most of the said power train and said flywheel are mounted on the primary axis and only the spool is coupled to said power train, said spool mounted on the secondary axis, said primary axis comprising a shaft with said flywheel rotationally mounted thereon;

(ii) a sun gear, planetary gears mounted in rotational mesh, in the same plane with said sun gear;

(iii) cage means, also comprising a brake means, for holding said planetary gears in a fixed radial disposition to said sun gear; and (iv) ring gear means, integrally located within ring gear housing means, in rotational mesh and in the same plane as said planetary gears, said ring gear means being free to spin on the primary axis independently of said shaft of said primary axis; and said ring gear housing in rotational mesh with said spool mounted on said secondary axis.

2. The fire escape as recited in claim 1, further comprising means for limiting the speed of descent of said cable means.

3. The fire escape as recited in claim 1 including a manual standby means in the power train to manually rewind the cable with including a handle for use in the instances that the automatic rewind mechanism fails to rewind the cable entirely onto the said spool.

4. The fire escape as recited in claim 1, further comprising a cable tensioning device for keeping the cable conveniently taut during initial hook-up procedures such that no unweildy excess of cable can be played-out of said spool means than is necessary.

5. The fire escape as recited in claim 1 further comrising descent engagement means, comprising:

(a) a catch means which is integral with the cage means on its outer periphery, which comes into engagement and hence rotational stop with abutment means, described below, so that the said power train can transfer rotational momentum from the spool to the flywheel;

(b) abutment means integral with the housing but coming into engagement with said catch means responsive to a pre-established forward pivotal position of the spool means and moving out of engagement in the backward pivotal position of the spool means;

(c) spring means for controlling the forward or backward pivotal position of the spool means responsive to either the weight of the escapee acting through the cable on the spool means or the absence of such weight on the cable when the escapee touches the ground, whereby said power train acts to pass on the angular momentum, from the unwinding spool during descent of the escapee, to the flywheel due to the forward pivotal position of the spool caused by the weight of the escapee on the cable means causing the cage means to come to a rotational stop against said abutment means and further acting to rewind the spool in the opposite direction by allowing angular momentum to flow from the flywheel to the spool responsive to disengagement of the catch means from the abutment means due to the action of the spring means when the full weight of the escapee is no longer operating on the cable means at the instant when the escapee is at ground level.

6. The fire escape as recited in claim 5, further comprising:

(a) a braking means rotationally integral to said sun gear, said brake means including brake shoes that expand outwardly at a defined angular velocity responsive to centrifugal force generated by the rotation of said sun gear, which brake means frictionally engage said cage means held rotationally static during the descent mode of the operation by the catch means engaging the abutment means;

(b) whereby, said braking means also serves a slipping function thereby temporarily disengaging said cage means and hence the spool means from the power train while the escapee detaches himself from the body securement means at ground level, said slipping function of said brake means also minimizing tension on the cable means when it is entirely rewound on the spool means while the flywheel continues to rotate due to remnant angular momentum.

* * * * *